United States Patent [19]

Berry et al.

[11] 4,388,999

[45] Jun. 21, 1983

[54] DOUBLE-WALLED CARTON AND BLANK FOR FORMING SAME

[75] Inventors: Chapman Berry, Old Lyme; Robert A. Hackenberg, East Lyme, both of Conn.

[73] Assignee: Robertson Paper Box Co., Inc., Montville, Conn.

[21] Appl. No.: 208,162

[22] Filed: Nov. 19, 1980

[51] Int. Cl.[3] ..... B65D 5/02; B65D 5/48

[52] U.S. Cl. ..... 220/416; 229/27; 229/37 R

[58] Field of Search ..... 220/416, 417, 418; 229/23 R, 34 HW, 27, 28, 15, 37 R

[56] References Cited

U.S. PATENT DOCUMENTS

| | | | |
|---|---|---|---|
| 975,121 | 11/1910 | Carter | 220/416 X |
| 2,513,902 | 7/1950 | Tyrseck | 220/416 |
| 2,578,775 | 12/1951 | Belsinger | 229/27 |
| 2,620,116 | 12/1952 | McDonough | 220/416 |
| 2,698,125 | 12/1954 | Vizcarrando | 229/27 |
| 2,701,088 | 2/1955 | Tryseck | 220/416 |
| 2,758,780 | 8/1956 | Imbs | 220/416 X |
| 2,997,220 | 8/1961 | Williamson | 220/416 |
| 3,240,417 | 3/1966 | Andreini | 220/416 |

FOREIGN PATENT DOCUMENTS

| | | | |
|---|---|---|---|
| 883150 | 11/1961 | United Kingdom | 229/27 |

*Primary Examiner*—Allan N. Shoap

*Attorney, Agent, or Firm*—Cesari and McKenna

[57] ABSTRACT

A collapsible carton of the type composed of a series of hinged-together panels folded spirally to form a double-walled tube has spacers at all four corners of the carton which extend between the corresponding inner and outer walls to maintain their spaced-apart relationships. A divider, preferably also double-walled, extends between opposite inner walls of the carton dividing the carton interior into two compartments.

17 Claims, 9 Drawing Figures

DOUBLE-WALLED CARTON AND BLANK FOR FORMING SAME

This invention relates to boxes and cartons. It relates more particularly to a double-walled carton which provides improved cushioning for the carton contents and a blank for forming same.

BACKGROUND OF THE INVENTION

Various forms of double-walled cartons have been developed of board material to provide inexpensive containers for the economical shipment and storage of fragile articles.

Generally, this type of carton comprises a single sheet of board material which, when folded, produces a smaller box held firmly in spaced relation inside a larger box. Thus, this type of carton performs more or less the same function as a single-walled box with a corrugated sleeve or liner.

Conventional cartons of this general type include means for maintaining the inner and outer walls of the carton in spaced-apart relation. Typically, such means include spacer lugs or tabs at some corners of the carton which extend from the corner score or hinge lines between the panels forming the inner sleeve and engage the inner surface of the outer sleeve. Examples of cartons of this general type are disclosed in U.S. Pat. Nos. 2,513,902; 2,533,070; 2,620,116 and 2,701,088.

Such prior cartons are disadvantaged, however, in that effective spacers are not provided at all four corners of the carton. For example, in the cartons described in the first two patents mentioned above, spacer tabs are not present at the upper right hand corner of those cartons as depicted in their FIG. 5. Consequently, the carton contents can be damaged by impacts against at least ons side of the box, e.g. the right hand side wall of the aforementioned cartons depicted in those two patents. In the carton described in the third of the aforementioned patents, on the other hand, spacer tabs do exist at the four corners of the carton; however, one set of those tabs is movable toward and away from the outer wall. Therefore, they do not provide sufficient buffering against hard impacts on that outer wall of the carton.

Also, it would be desirable if a double-walled carton of this general type could have effective interior shock absorbing partitions so that a plurality of fragile articles contained in the carton can be isolated from one another. There do exist double-walled cartons having a single layer partition; however, they do not constitute adequate shock absorbers between the adjacent articles in the carton in all applications. Moreover, such prior partitioned double-walled cartons still do not have spacers between the inner and outer carton walls at all four corners of the carton.

SUMMARY OF THE INVENTION

Accordingly, the present invention aims to provide an improved double-walled carton.

Another object of the invention is to provide a carton of this general type whose inner and outer carton walls are maintained in spaced-apart relation at all four corners of the carton.

Another object of the invention is to provide a double-walled carton of the aforementioned type having an effective interior partition to isolate a plurality of fragile articles in the carton.

Yet another object of the invention is to provide a double-walled carton having a double-walled interior partition.

Still another object of the invention is to provide a carton of the aforementioned type which can be formed from a single cardboard blank using a minimum amount of board material.

A further object of the invention is to provide a blank for forming a carton having one or more of the above characteristics.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the carton made in accordance with the present invention comprises essentially a carton within a carton in that it has four inner walls and four outer walls maintained in spaced-apart relation by spacer tabs or lugs formed at all four hinge lines of the carton inner wall which tabs project toward and engage the inner surfaces of the carton outer walls. Thus, these tabs or lugs function as stand-offs between the inner and outer carton walls which assure the spaced-apart relationship of those walls. Therefore, the carton contents are not materially affected by impacts on any of the carton walls. Furthermore, even if the carton is shaken or jostled, the all-around, spaced-apart carton walls provide sufficient buffering for the carton contents that damage to the contents is unlikely.

In a preferred embodiment of the present carton, the carton interior is divided into two compartments by an interior partition. Furthermore, that interior partition is also desirably double-walled to provide effective buffering between the articles contained in the adjacent carton compartments.

The present carton is constructed of a single blank using a minimum amount of board material and is folded and glued in a minimum number of steps on standard folding apparatus. Therefore, the cost of the carton is kept to a minimum.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
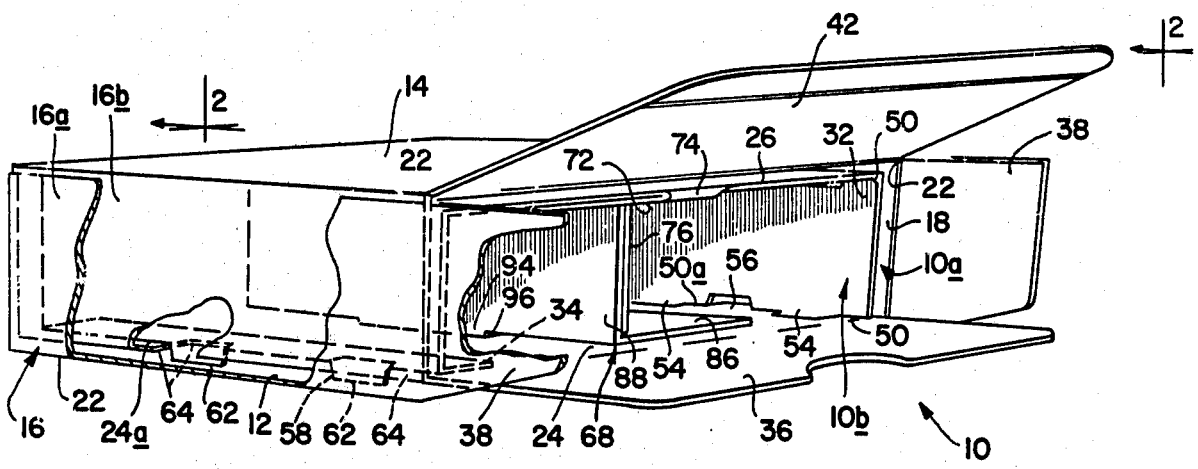
FIG. 1 is a perspective view with parts broken away illustrating a box embodying the principles of this invention.
Figure 2:
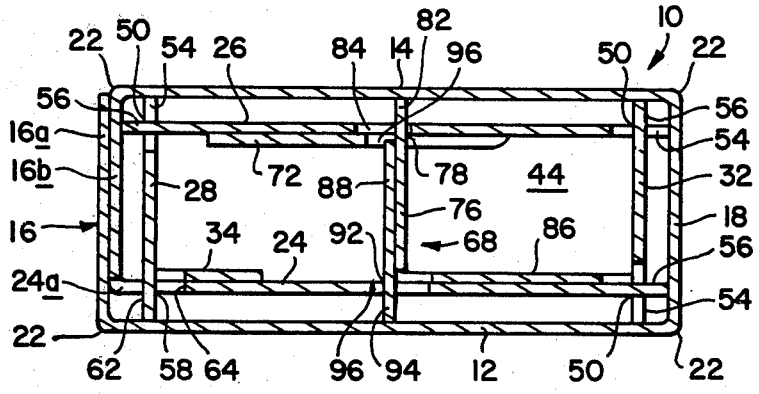
FIG. 2 is a sectional view along line 2—2 of FIG. 1.

Referring to FIGS. 1 and 2 of the drawings, a carton indicated generally at 10 is shown tipped over onto its front wall for clarity. In other words, the right hand end of the carton as depicted in FIG. 1 is really the upper end. Carton 10 may be considered a carton within a carton in that it comprises an outer section 10*a* and an inner section 10*b*. The spacing between the inner and outer sections is exaggerated somewhat in FIG. 2 for clarity. Section 10*a* comprises a front wall 12, a rear wall 14 and a pair of side walls 16 and 18 all hinged together along hinge lines 22. Actually the side wall 16 is composed of two panels 16*a* and 16*b* which are glued together face to face. All of the aforesaid panels being part of a single panel series are folded spirally to form a double-walled tube.

The carton inner section comprises a front wall 24, a rear wall 26 and a pair of side walls 18 and 32 all hinged together at their edges. A glue flap 34 hinged to the free side edge of wall 28 is glued to inner front wall 24 to maintain the integrity of the carton. An inner top cover flap 36 is hinged to the upper edge of wall 24. Also auxiliary cover flaps 38 are hinged to the upper edges of the outer walls 16 and 18, while a main cover flap 42 is hinged to outer rear wall 14. A similar arrangement of flaps closes off the bottom of the carton. More particularly, there is an inner bottom cover flap 44 hinged to the lower edge of inner wall 26 and a pair of auxiliary cover flaps 46 hinged to the lower edges of outer side walls 16 and 18 and a main cover flap 48 hinged to the lower edge of outer rear wall 14 (See FIG. 3).

Still referring to FIGS. 1 and 2, the present carton is particularly advantaged because spacers or stand-offs are provided between the inner and outer carton sections 10*a* and 10*b* at all four corners from the carton. More particularly, the carton inner walls 24 and 32; 32 and 26 and 26 and 28 respectively are connected by interrupted hinge lines 50 and the board material is slit between each hinge line segment 50*a* so as to form a series of staggered tabs 54 and 56 with the tabs 54 extending in one direction from the hinge line 50 and the tabs 56 extending in the opposite direction from that hinge line. In other words, at the hinge line 50 between wall panels 24 and 32, tabs 54 cut from panels 24 alternate with tabs 56 cut from panel 32. Resultantly when the carton is squared up as shown in FIG. 1, the tabs 54 and 56 extend at right angles to one another with tabs 54 engaging the carton outer front wall 12 and the tabs 56 projecting toward and engaging the carton outer side wall 18. Consequently, the maintenance of the spcing between the carton inner and outer walls at the lower right hand edge or corner of the carton 10 as depicted in FIGS. 1 and 2 is assured. Similar sets of alternating, in-quadrature tabs 54 and 56 are provided between the inner and outer wall panels at the upper right hand edge of the carton and at the upper left hand edge of the carton as viewed in FIGS. 1 and 2.

The maintenance of the spacing between the inner and outer carton sections 10*a* and 10*b* at the lower left hand edge of the carton achieved by somewhat different means. More particularly, the glue flap 34 is connected to wall panel 28 by an interrupted hinge line 58 and the board material in the glue flap 34 is slit between the hinge line segments 58*a* to provide a single set of tabs 62. In addition, generally rectangular openings 64 are formed in wall panel 24 adjacent the hinge line 58 between that panel and the glue flap. These openings 64 are aligned with the tabs 62 so that, when the carton is made up, the tabs 62 project through openings 64 and engage the carton front wall 12 thereby assuring that the spacing between the carton inner and outer front wall panels 12 and 24 are maintained.

The standoff between the inner and outer side wall panels 28 and 16 at the lower left hand edge of the carton is achieved by shifting the hinge line 58 between panel 28 and the glue flap 34 along the blank relative to the hinge line 22 between panels 12 and 16*a*. Resultantly, when the carton is made up and squared up, hinge line 58 is displaced laterally on panel 24 relative to the nearest hinge line 22 as best seen in FIG. 2. In other words, the segment 24*a* of panel 24 between hinge lines 22 and 58 constitutes effectively a single spacer or stand-off extending substantially the full height of the carton.

Figure 3:
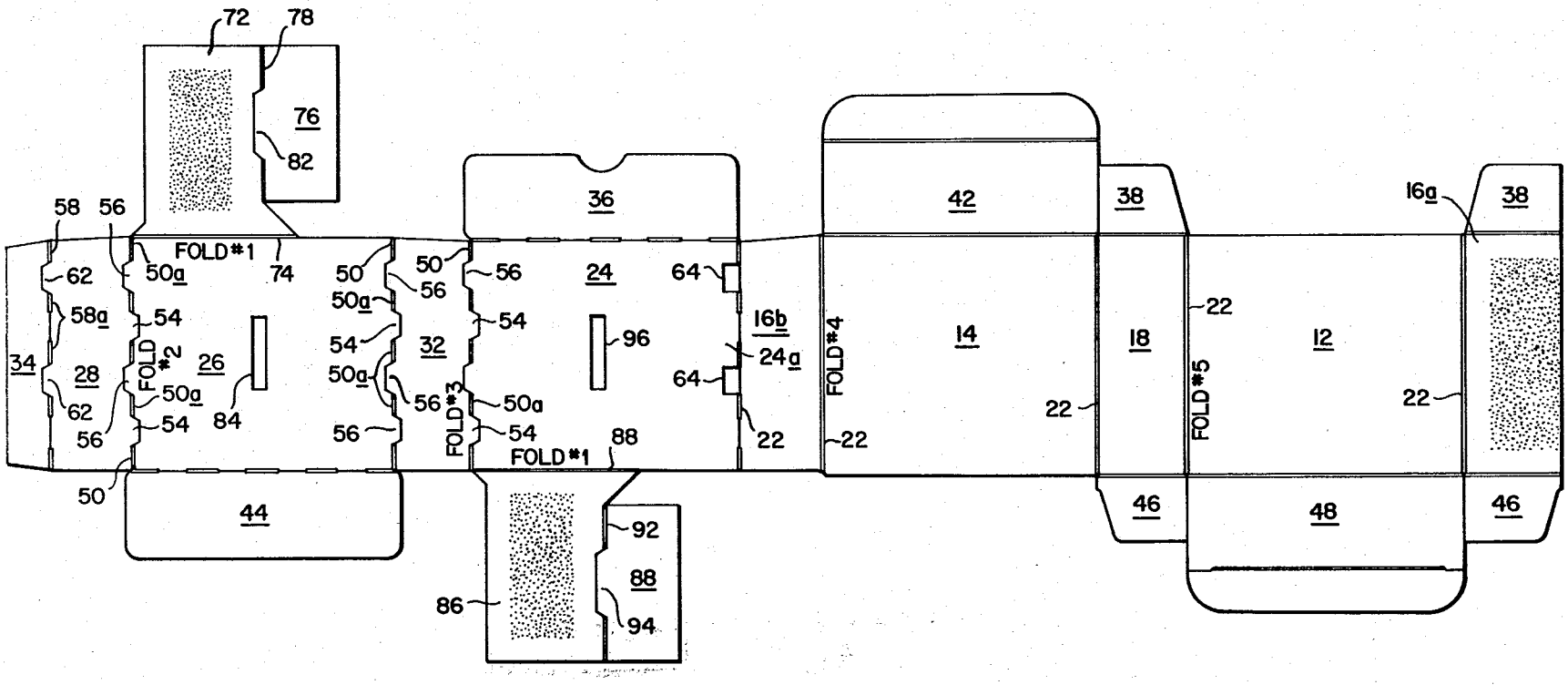
FIG. 3 is a top plan view of the blank from which the FIG. 1 carton is constructed.

Preferably also, the carton 10 includes an interior divider indicated generally at 68 which divides the carton interior into two side-by-side compartments. As shown in FIGS. 1 to 3, the divider comprises a generally rectangular panel 72 hinged at 74 to the upper edge of rear wall panel 26 at the side thereof adjacent wall panel 28. Panel 72 is folded on line 74 and adhered to the inside surface of panel 26. A generally rectangular panel 76 is hinged to the side edge of panel 72 along an interrupted hinge line 78. The board material of panel 72 at the hinge line interruption is also slit to form a tab 82. Also a slot 84 is formed in panel 26 which is aligned with tab 82 when panel 72 is folded flush against panel 26.

Another generally rectangular panel 86 is hinged along hinge line 88 to the lower edge of the carton inner front wall panel 24 adjacent its boundary with wall panel 32. Also, a rectangular divider panel 88 is hinged alone line 92 to the side edge of panel 86 remote from panel 32. Like hinge 78, the hinge line 92 is interrupted and the board material in panel 86 between the hinge segments is slit to form a tab 94 which is aligned with a slot 96 in panel 24 when panel 86 is folded back and adhered to the inside surface of panel 24 as shown in FIG. 2.

The two panels 76 and 88 are glued together when the box is made up to form the two-ply divider 68. When the carton 10 is squared up as depicted in FIGS. 1 and 2, the tabs 82 and 94 project through slots 84 and 96 respectively and engage the carton outer rear and front walls 14 and 12 respectively ensuring that the carton inner and outer walls remain spaced apart across the entire width of the carton.

The carton construction described herein thus maintains a cushioning space between the inner and outer carton sections 10*a* and 10*b* at all four corners of the carton as well as along lines vertically dividing the carton. Therefore, the articles in the two carton compartments are protected all around from impact against the carton outer walls and are isolated from each other.

Figure 4:
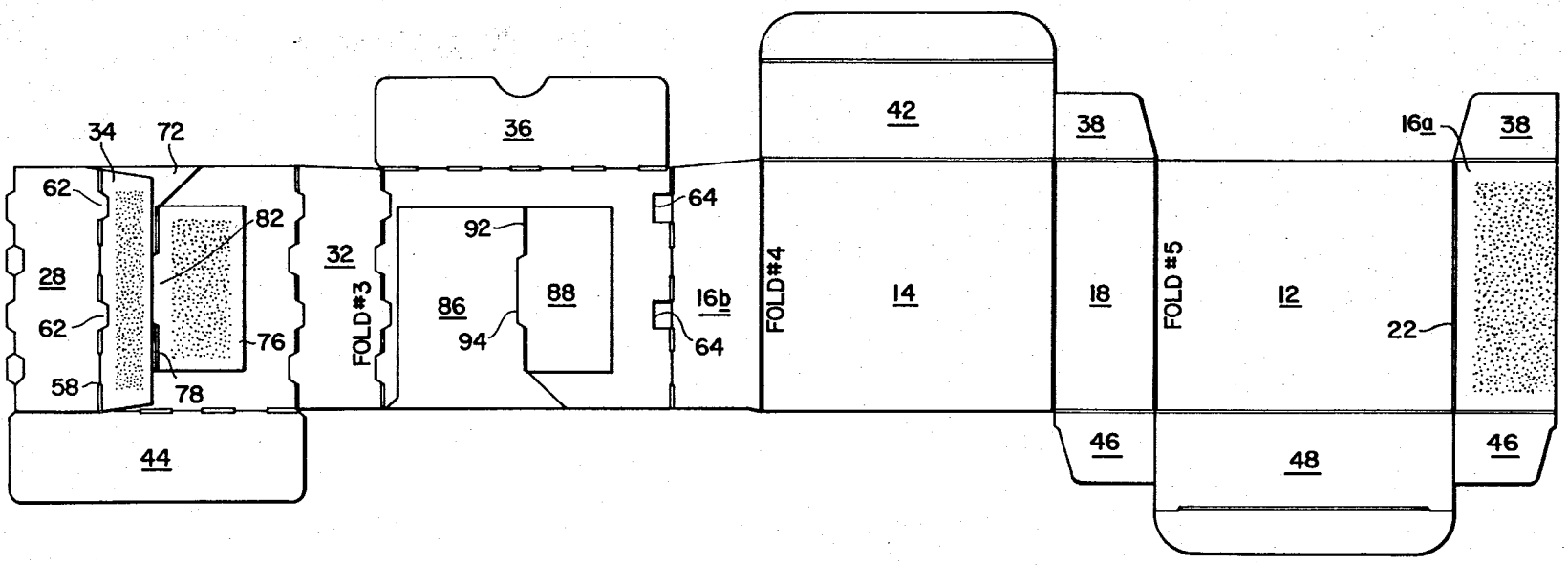
FIGS. 4 to 7 are similar views showing the blank folding sequence to form the finished carton of FIG. 1.
Figure 5:
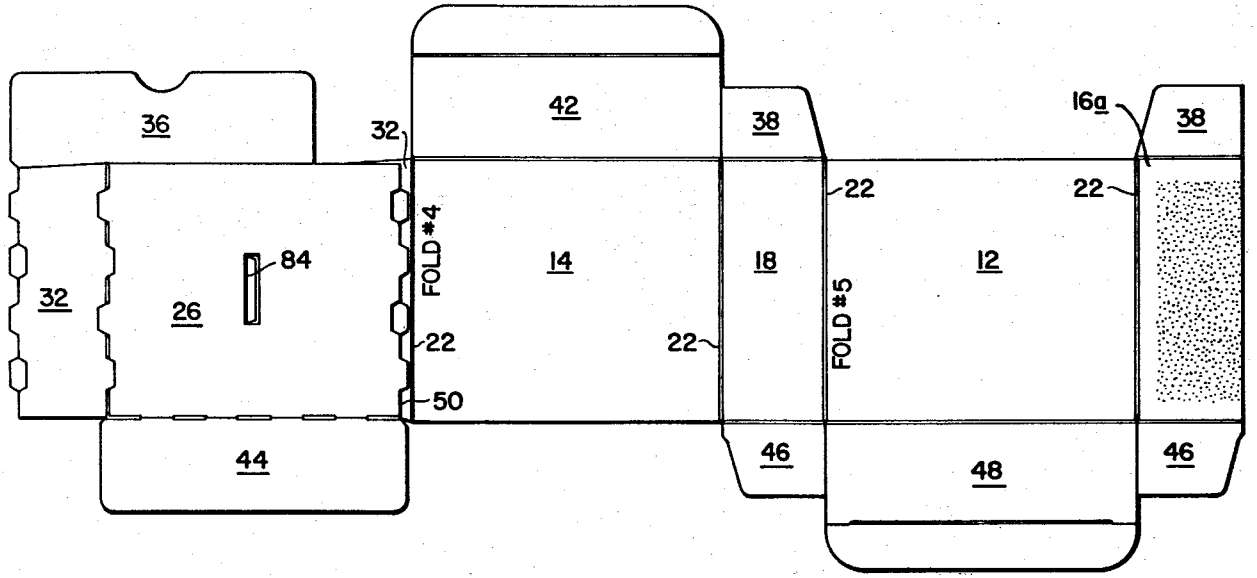
Figure 6:
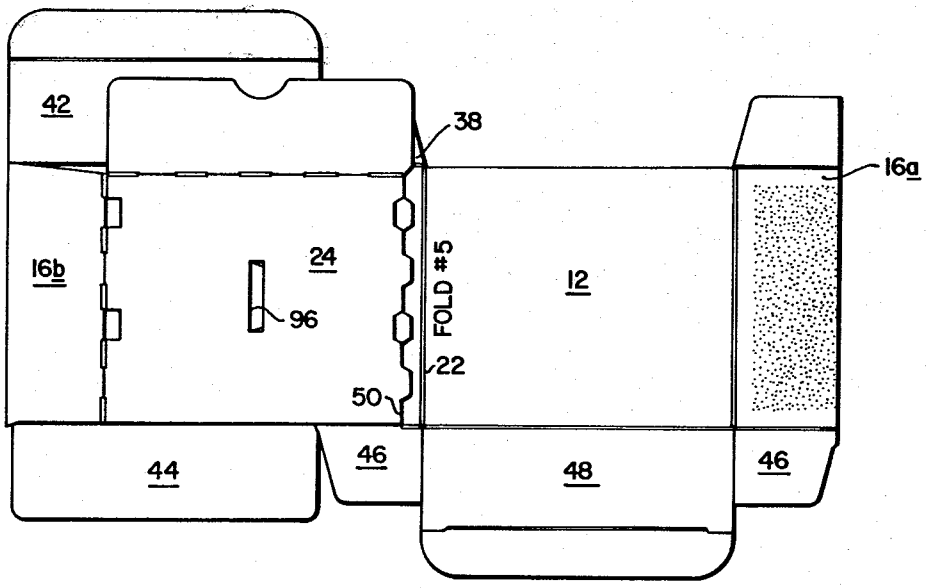
Figure 7:
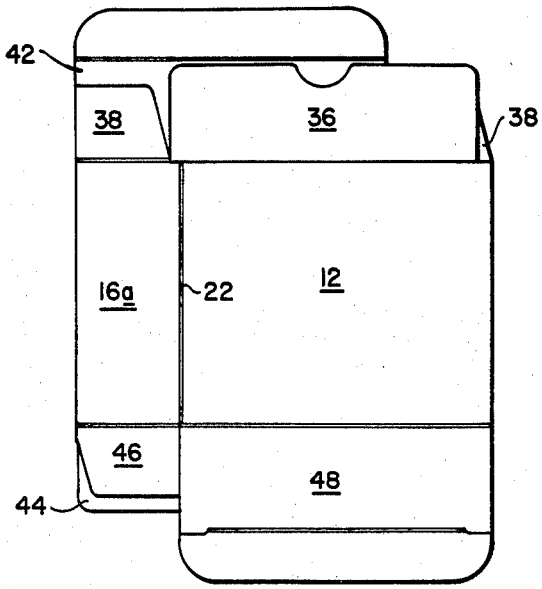

FIGS. 3 to 7 illustrate the blank from which the FIG. 1 carton is made and the folding sequence followed by the folding apparatus. The glue areas are indicated by stippling. As indicated from these drawing figures, glue is applied to panels 72 and 86 after which those panels are folded flush against panels 26 and 24 respectively. Next, panel 28 and glue flap 34 are folded on hinge line 50 flush against panel 26 and glue is applied to the glue flap, the panel 76 and panel 16*a* as depicted in FIG. 4. Then, referring to FIG. 5, the blank is folded along the hinge line 50 between panels 24 and 32 so that glue flap 34 adheres to the right hand edge margin of panel 24 and the divider panel 76 adheres to divider panel 88. As shown in FIG. 6, the next fold is made at the hinge line 22 between panels 14 and 16*b*. The final fold shown in FIG. 7 is at the hinge line 22 between panels 12 and 18 which results in panel 16*a* adhering to panel 16*b*, completing the carton.

The carton can be shipped and stored in its flattened condition illustrated in FIG. 7 so that it occupies a minimum amount of space. When squared up, the divider panels automatically swing away from the carton front and rear walls to vertically divide the carton interior into two vertical compartments.

Figure 8:
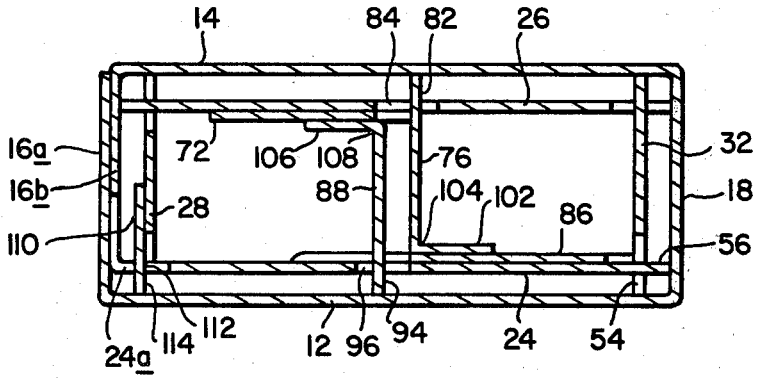
FIG. 8 is a view similar to FIG. 2 showing a slightly different carton embodiment.
Figure 9:
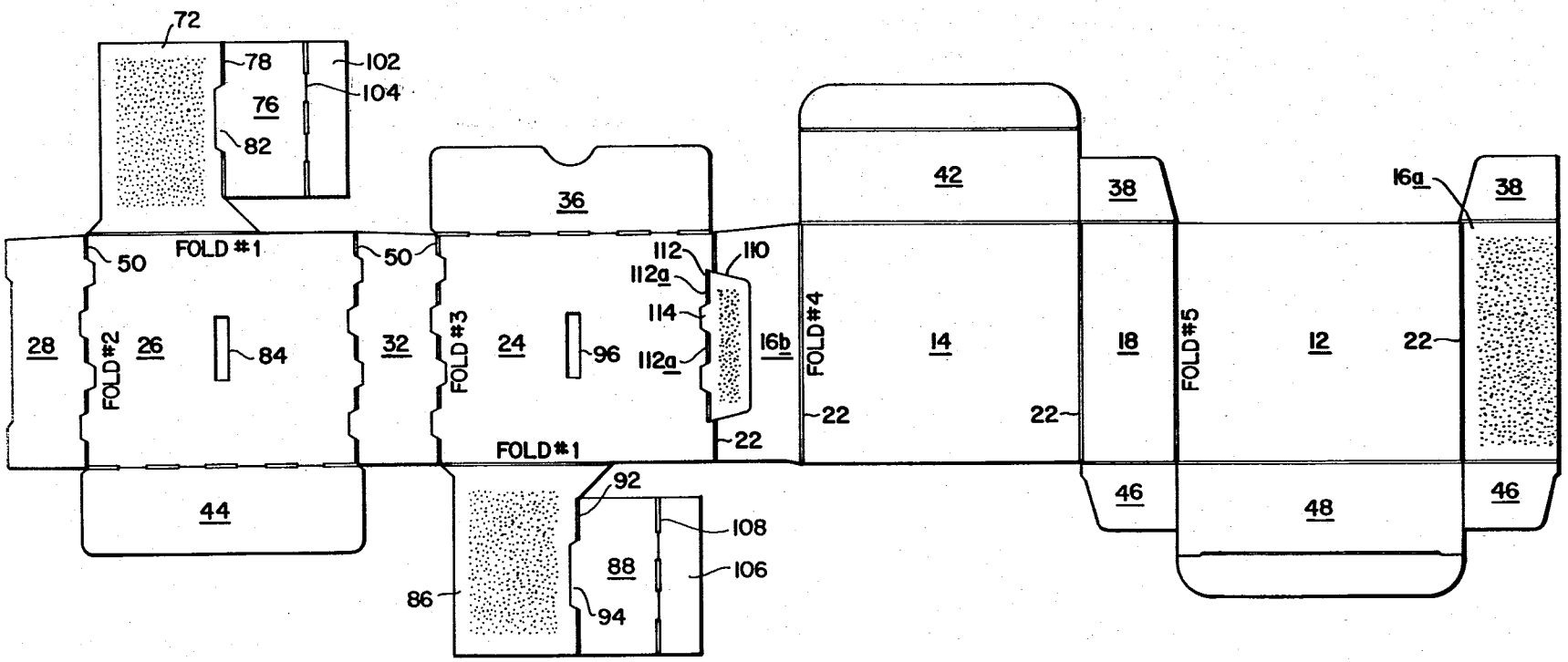
FIG. 9 is a top plan view of the blank from which the FIG. 8 carton is made.

Sometimes it is desirable to provide a shock absorbing buffer between the articles in the two compartments inside the carton. A carton with such a shock absorbing divider is illustrated in FIGS. 8 and 9. This carton embodiment has many elements in common with the FIG. 1 embodiment and these in-common elements carry the same identifying numerals. Comparing FIGS. 3 and 9, it can be seen that the main differences between the FIGS. 1 and 8 cartons lie in the presence of a glue flap 102 hinged at 104 to the free side edge of divider panel 76 and a similar glue flap 106 hinged at 108 to the corresponding side edge of panel 88.

Also, instead of a glue flap being hinged to panel 28, a glue flap 110 is struck from panels 16*b* and 24 adjacent the hinge line 22 between those panels. The flap 110 has a hinge line 112 which is spaced just to the left of hinge line 22 (FIG. 9). Accordingly, when the carton is made up and erected, a wall segment 24*a* exists between wall panel 16*b* and the flap 110 adhered to inner wall panel 28 which segment functions as a spacer between those wall panels similar to the spacer segment 24*a* in the FIG. 1 carton embodiment. Furthermore, hinge line 112 is interrupted like hinge 58 in the FIG. 1 embodiment and tabs 114 are formed between the hinge line segments 112*a* which correspond to the tabs 62 in the FIG. 1 carton. The reason for the shift in the location of the glue flap is because if a glue flap were hinged to panel 28, after fold number 3, that glue flap would adhere to glue flap 106 and prevent the carton from being squared up.

In order to create the spacing between the divider panels 76 and 88, in the FIG. 9 blank the hinge line 78 is spaced from the glue flap hinge line 50 a distance slightly greater than half the width of panel 24. Therefore, hinge line 78 is offset slightly to the right of the panel 21 vertical center line. Hinge line 92 is similarly displaced slightly to the right of the panel 24 center line. Resultantly, when the carton is formed and erected as depicted in FIG. 8, the front and rear edges of the divider panels 76 and 88 are spaced apart laterally by twice the hinge line offset.

As with the FIG. 1 carton embodiment, tabs 82 and 94 project through openings 84 and 96 respectively and engage the front and rear carton outer walls to provide standoffs assuring that the relatively large area carton front and rear walls remain spaced apart over their entire areas. Therefore, spaced-apart shock absorbing walls are provided all around each of the fragile articles contained in the two compartments within the carton.

To form the FIG. 8 carton, the FIG. 9 blank is folded and glued as indicated in FIG. 9. In general, it is folded the same way as the FIG. 3 blank.

The FIGS. 1 and 8 carton embodiments are each formed of a single blank which is shaped so that an array of such blanks can be interfittingly laid out on a web. Therefore, the amount of board material required to make the cartons is kept to a minimum. Moreover, each blank is folded and glued in a minimum number of steps. Therefore, the overall costs of the cartons are relatively small.

It will thus be seen that the objects set forth above, among those made apparent from the preceding description, are efficiently attained, and, since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A collapsible carton of the type composed of a series of generally rectangular hinged-together panels folded spirally to form a double-walled tube having two pairs of opposite inner walls and two pairs of opposite outer walls, the innermost and outermost panels of the series constituting glue flaps adhered to first and second underlying panels respectively to maintain the integrity of the tube, the first underlying panel forming one of said inner walls, the outermost panel forming a part of one of said outer walls, spacers struck from the inner walls of the tube at the three corners thereof remote from said innermost panel for engaging the outer walls of the tube to maintain the spacing between the inner and outer walls at those corners, the improvement comprising at least one tab struck from the innermost panel adjacent its hinge line to the next outer panel in the series, means defining at least one tab-registering opening in the first underlying panel to which the innermost panel is adhered for receiving said at least one tab whereby said tab can engage the panel to which the outermost panel is hinged so as to maintain a space between the innermost panel and the panel to which the outermost panel is hinged, spacer means formed by said first underlying panel and extending from the second underlying panel to said next outer panel so as to maintain a space between said next outer and outermost panels, a divider wall extending between and generally perpendicular to one pair of opposite inner walls of the tube and extending substantially the full length of said one pair of opposite inner walls so as to divide the interior of the carton into two compartments, each divider wall including first and second divider panels, means for hingedly connecting said divider panels at corresponding first boundaries thereof to different ones of said one pair of oppposite inner walls, said divider panels having their corresponding opposite boundaries terminating adjacent different other ones of said one pair of opposite inner walls, and means for adhering said divider panels to each other.

2. The carton defined in claim 1 wherein said spacer means is hinged to said second underlying panel to which said outermost panel is adhered and constitutes an edge segment of said first underlying panel to which said innermost panel is adhered.

3. The carton defined in claim 1 and further including outer cover flaps hinged to the upper and lower edges of a plurality of the outer walls of the tube.

4. The carton defined in claim 3 and further including a plurality of inner cover flaps, one of said inner flaps being hinged to the upper edge of an inner wall of the tube and another of said inner flaps being hinged to the lower edge of an inner wall of the tube.

5. The carton defined in claim 1 wherein there are a plurality of tabs and tab-registering openings spaced apart along said hinge line.

6. The carton defined in claim 1 and further including a divider tab projecting from each of the opposite side boundaries of the divider wall and a divider tab-registering opening formed in each of said one pair of opposite inner walls of the tube so that said divider tabs can project through said openings and engage the corresponding outer walls of the tube so as to provide spacers between said one pair of opposite inner walls of the tube and said corresponding outer walls thereof substantially at the centers of those walls.

7. The carton defined in claim 1 wherein said divider wall comprises closely spaced, parallel divider panels.

8. A collapsible carton of the type composed of a series of generally rectangular hinged-together panels folded spirally to form a double-walled four-sided tube having two pairs of opposite inner wall panels and two pairs of opposite outer wall panels, the innermost and outermost panels in the series constituting glue flaps adhered to first and second underlying panels respectively to maintain the integrity of the tube, the first underlying panel forming one of said inner walls, the outermost panel forming a part of one of said outer walls, spacers struck from the inner walls of the tube at the three corners thereof remote from said innermost panel for engaging the outer walls of the tube to maintain the spacing between the inner and outer walls at those corners, the improvement comprising a pair of closely spaced, parallel divider panels extending between and generally perpendicular to one pair of opposite inner walls of the tube and extending the full length of said one pair of opposite inner walls so as to divide the interior of the carton into two compartments, means for hingedly connecting said divider panels at corresponding first boundaries thereof to different ones of said one pair of opposite inner walls and means for hingedly connecting corresponding opposite boundaries of said divider panels to different other ones of said one pair of opposite inner walls.

9. A blank for forming a collapsible double-walled carton having spacers between the inner and outer walls at all four corners of the carton comprising a series of at least nine wall panels hinged together along parallel hinge lines, panel means hinged to the upper and lower boundaries respectively of the second and fourth panels from one end of the series, each said panel means including a first panel hinged to one of said upper and lower boundaries along a hinge line perpendicular to the hinge lines between said wall panels and a divider panel hinged to a side boundary of said first panel along a hinge line parallel to the hinge lines between said wall panels, said divider panels having substantially the same width as the first and third wall panels, spacer tabs struck from the wall panels on opposite sides of at least three hinge lines between adjacent wall panels in the series so that, when said adjacent wall panels are oriented perpendicular to one another, orthogonally directed tabs are formed at each of three said hinge lines, a glue flap hinged to one of said wall panels in the series and one or more additional spacer tabs formed at the hinge line connecting said glue flap and said one panel.

10. The blank defined in claim 9 wherein the glue flap is hinged to said one end of said series.

11. The blank defined in claim 10 wherein said additional spacer tabs are struck from the glue flap.

12. The blank defined in claim 11 and further including openings formed in said fourth wall panel adjacent its hinge line to the fifth wall panel in the series, there being at least as many openings as additional tabs and said openings being arranged and adapted to receive said additional tabs when the blank is folded and squared up.

13. The blank defined in claim 9 wherein said glue flap is hinged to an intermediate wall panel in the series.

14. The blank defined in claim 13 wherein said glue flap hinge line is spaced closely from the hinge line of said intermediate wall panel to the next adjacent wall panel in the series.

15. A collapsible carton of the type composed of a series of generally rectangular hinged-together panels folded spirally to form a double-walled four-sided tube having two pairs of opposite inner walls and two pairs of opposite outer walls, the innermost and outermost panels in the series constituting glue flaps adhered to first and second underlying panels respectively to maintain the integrity of the tube, the first underlying panel forming one of said inner walls, the outermost panel forming a part of one of said outer walls, spacers struck from the inner walls of the tube at the three corners thereof remote from said innermost panel for engaging the outer walls of the tube to maintain the spacing between the inner and outer walls at those corners, the improvement comprising a pair of closely spaced, parallel divider panels extending between and generally perpendicular to one pair of opposite inner walls panels of the tube so as to divide the interior of the carton into two compartments, means for hingedly connecting opposite said boundaries of said divider panels to opposite ones of said one pair of inner wall, a divider tab projecting from one side boundary of one divider panel and the opposite side boundary of the other divider panel and a divider tab-registering opening formed in each one of said one pair of opposite inner walls so that said divider tabs can project through said openings and engage the corresponding outer walls of the tubes so as to provide spacers between said pair of opposite inner walls of the tube and the corresponding outer walls thereof near the centers of those walls.

16. A blank for forming a collapsible double-walled carton having spacers between the inner and outer walls at all four corners of the carton comprising a series of at least nine wall panels hinged together along parallel hinge lines, panel means hinged to the upper and lower edges respectively of the second and fourth panels from one end of the series, each said panel means including a first panel hinged to one of said upper and lower edges along a hinge line perpendicular to the hinge lines between said wall panels, a divider panel hinged to a side edge of said first panel along a hinge line parallel to the hinge lines between said wall panels and a glue flap hinged to said divider panel at the free side edge thereof, spacer tabs struck from the wall panels on opposite sides of at least three hinge lines between adjacent wall panels in the series so that, when said adjacent wall panels are oriented perpendicular to one another, orthogonally directed tabs are formed at each of three said hinge lines, an additional glue flap hinged to an intermediate wall panel in the series and one or more additional spacer tabs formed at the hinge line connecting said additional glue flap and said one of said panels.

17. The blank defined in claim 16 wherein the hinge line between the first and divider panels of each panel means is offset laterally from the center line of the wall panel to which that panel means is hinged.

* * * * *